US011409212B2

(12) United States Patent
Yoshinaga

(10) Patent No.: US 11,409,212 B2
(45) Date of Patent: Aug. 9, 2022

(54) HEATING DEVICE, FIXING DEVICE, AND IMAGE FORMING APPARATUS INCLUDING AN AIRFLOW PATH AND AN OUTER AIRFLOW PATH

(71) Applicant: Ricoh Company, Ltd., Tokyo (JP)

(72) Inventor: Hiroshi Yoshinaga, Chiba (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/366,725

(22) Filed: Jul. 2, 2021

(65) Prior Publication Data

US 2022/0026834 A1 Jan. 27, 2022

(30) Foreign Application Priority Data

Jul. 21, 2020 (JP) ..... JP2020-124422
Nov. 2, 2020 (JP) ..... JP2020-183692

(51) Int. Cl.
*G03G 21/20* (2006.01)
*G03G 15/20* (2006.01)

(52) U.S. Cl.
CPC ..... *G03G 15/2017* (2013.01); *G03G 15/2053* (2013.01); *G03G 21/206* (2013.01)

(58) Field of Classification Search
CPC ..... G03G 15/2017; G03G 21/1685; G03G 21/206
USPC ..... 399/92–94, 122
See application file for complete search history.

(56) References Cited

U.S. PATENT DOCUMENTS 5,819,136 A * 10/1998 Tomita et al. ..... G03G 15/2039 399/92
6,173,132 B1 * 1/2001 Kida et al. ..... G03G 21/206 399/92
7,469,112 B2 * 12/2008 Yuasa ..... G03G 21/206 399/92
7,720,415 B2 * 5/2010 Murano ..... G03G 21/1685 399/122
2017/0255142 A1 * 9/2017 Yamanaka ..... G03G 15/2017
2020/0033771 A1 1/2020 Furuichi et al.
2020/0103799 A1 4/2020 Adachi et al.
2020/0174408 A1 6/2020 Furuichi et al.
2020/0183307 A1 6/2020 Furuichi et al.

FOREIGN PATENT DOCUMENTS

JP 2014-224990 12/2014
JP 2018-076174 5/2018

* cited by examiner

*Primary Examiner* — William J Royer
(74) *Attorney, Agent, or Firm* — Xsensus LLP

(57) ABSTRACT

A heating device includes a heater, a housing, an airflow path, and an outer airflow path. The airflow path is configured to flow air from an airflow generator into the housing. The outer airflow path is configured to flow air from the airflow generator to an outer face of the housing.

11 Claims, 9 Drawing Sheets

HEATING DEVICE, FIXING DEVICE, AND IMAGE FORMING APPARATUS INCLUDING AN AIRFLOW PATH AND AN OUTER AIRFLOW PATH

CROSS-REFERENCE TO RELATED APPLICATIONS

This patent application is based on and claims priority pursuant to 35 U.S.C. § 119(a) to Japanese Patent Applications No. 2020-124422, filed on Jul. 21, 2020 and No. 2020-183692, filed on Nov. 2, 2020 in the Japan Patent Office, the entire disclosure of each of which is hereby incorporated by reference herein.

BACKGROUND

Technical Field

Embodiments of the present disclosure generally relate to a heating device, a fixing device, and an image forming apparatus. In particular, the embodiments of the present disclosure relate to a heating device, a fixing device with the heating device for fixing a toner image on a recording medium, and an image forming apparatus with the fixing device for forming an image on a recording medium.

Related Art

As a heating device used in an image forming apparatus, such as a copier or a printer, there are known, for example, a fixing device that fixes toner on a sheet under heat and a drying device that dries ink on a sheet. In such a heating device, an airflow generator is disposed outside the heating device and causes airflow flowing inside the heating device to cool the inside of the heating device.

SUMMARY

This specification describes an improved heating device that includes a heater, a housing, an airflow path, and an outer airflow path. The airflow path is configured to flow air from an airflow generator into the housing. The outer airflow path is configured to flow air from the airflow generator to an outer face of the housing.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

and

Figure 17:
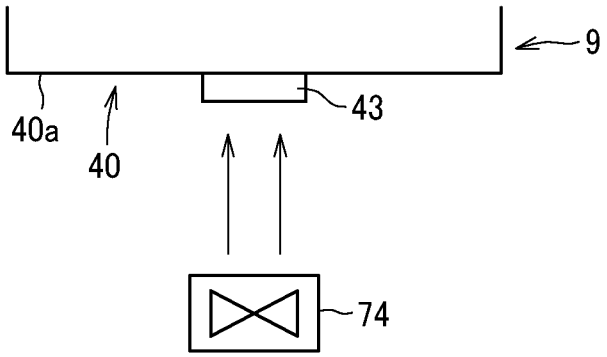

FIG. 17 is a schematic diagram illustrating another blower fan to cool the electronic board.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

Embodiments of the present disclosure are described below with reference to the drawings. Identical reference numerals are assigned to identical components or equivalents and a description of those components is simplified or omitted. In the following description of each embodiment, a fixing device that fixes a toner image onto a sheet by heat is described as an example of a heating device.

Figure 1:
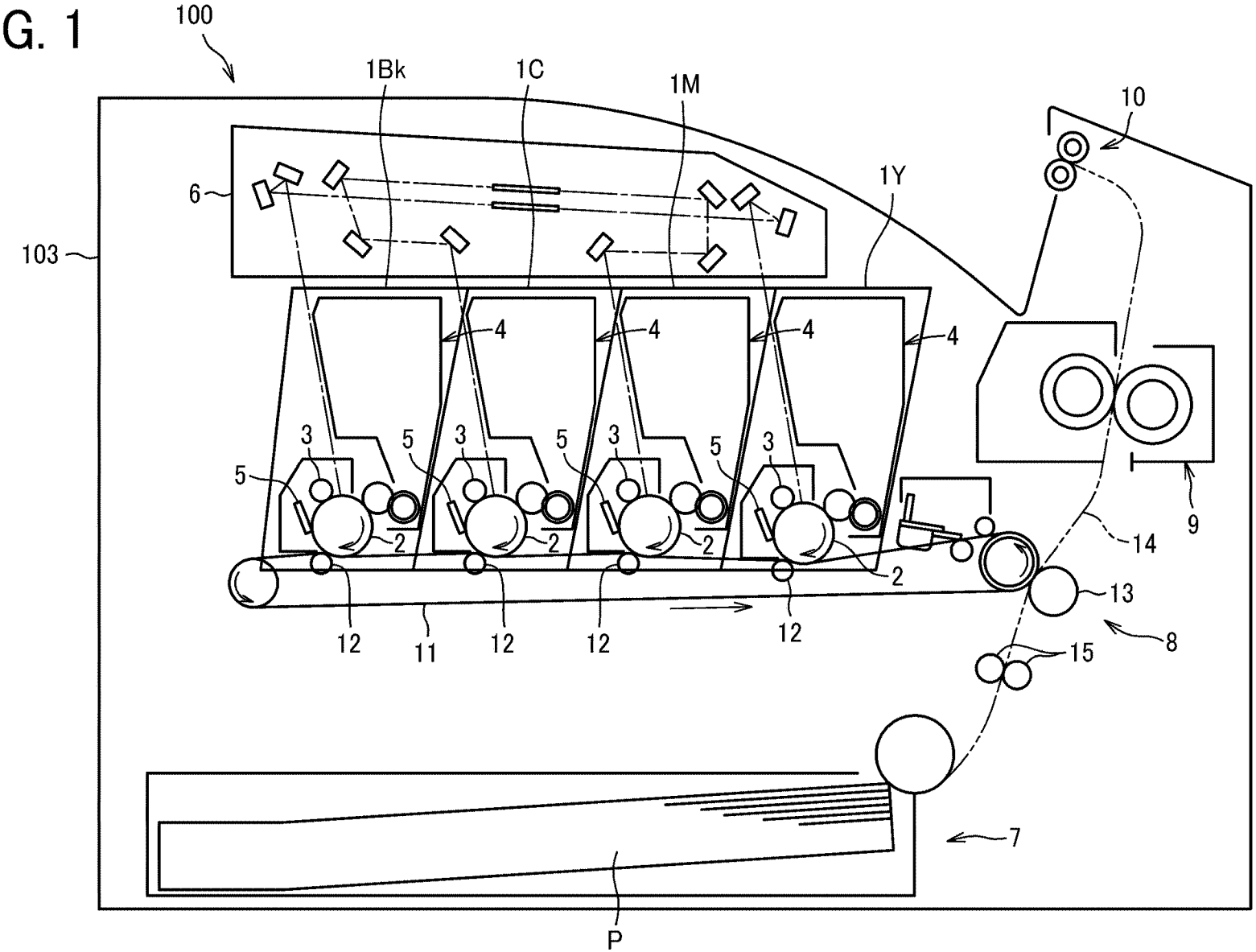
FIG. 1 is a schematic sectional view of an image forming apparatus according to an embodiment of the present disclosure.

FIG. 1 is a schematic sectional view of an image forming apparatus 100 according to an embodiment of the present disclosure.

As illustrated in FIG. 1, the image forming apparatus 100 includes four image forming units 1Y, 1M, 1C, and 1Bk serving as image forming devices, respectively. The image forming units 1Y, 1M, 1C, and 1Bk are removably installed in a body 103 of the image forming apparatus 100. The image forming units 1Y, 1M, 1C, and 1Bk have a similar configuration except that the image forming units 1Y, 1M, 1C, and 1Bk contain developers in different colors, that is, yellow, magenta, cyan, and black, respectively, which correspond to color separation components for a color image. Specifically, each of the image forming units 1Y, 1M, 1C, and 1Bk includes: a photoconductor 2 in a drum-like shape as an image bearer; a charger 3 to charge a surface of the photoconductor 2; a developing device 4 configured to form a toner image by supplying toner, as a developer, to a surface of the photoconductor 2; and a cleaner 5 to clean the surface of the photoconductor 2.

The image forming apparatus 100 further includes an exposure device 6 to expose the surface of each photoconductor 2 to form an electrostatic latent image, a sheet feeder 7 to supply a sheet P as a recording medium, a transfer device 8 to transfer the toner image formed on each photoconductor 2 onto the sheet P, a fixing device 9 as a heating device according the present disclosure to fix the transferred toner image onto the sheet P, and a sheet ejection device 10 to eject the sheet P outside the image forming apparatus 100.

The transfer device 8 includes: an intermediate transfer belt 11 in the form of an endless belt stretched taut with multiple rollers, as an intermediate transferor; four primary transfer rollers 12 each as a primary transferor to transfer the toner image formed on each photoconductor 2 onto the intermediate transfer belt 11; and a secondary transfer roller 13 as a secondary transferor to transfer the toner image transferred onto the intermediate transfer belt 11 onto the sheet P. The plurality of primary transfer rollers 12 are pressed against the photoconductors 2, respectively, via the intermediate transfer belt 11. Thus, the intermediate transfer belt 11 contacts each of the photoconductors 2, forming a primary transfer nip therebetween. On the other hand, the secondary transfer roller 13 contacts, via the intermediate transfer belt 11, one of the plurality of rollers around which the intermediate transfer belt 11 is stretched. Thus, a secondary transfer nip is formed between the secondary transfer roller 13 and the intermediate transfer belt 11.

The image forming apparatus 100 accommodates a sheet conveyance path 14 through which the sheet P fed from the sheet feeder 7 is conveyed. A timing roller pair 15 is disposed in the sheet conveyance path 14 at a position between the sheet feeder 7 and the secondary transfer nip defined by the secondary transfer roller 13.

Referring to FIG. 1, a description is provided of printing processes performed by the image forming apparatus 100 having the construction described above.

When the image forming apparatus 100 receives an instruction to start printing, a driver drives and rotates the photoconductor 2 clockwise in FIG. 1 in each of the image forming units 1Y, 1M, 1C, and 1Bk. The charger 3 charges the surface of the photoconductor 2 uniformly at a high electric potential. Next, based on image data of a document read by a scanner or print data transmitted by a terminal device, the exposure device 6 exposes the surface of the photoconductor 2. Then, the potential of an exposed surface drops, and the electrostatic latent image is formed on the photoconductor 2. The developing device 4 supplies toner to the electrostatic latent image formed on the photoconductor 2, forming a toner image thereon.

When the toner images formed on the photoconductors 2 reach the primary transfer nips defined by the primary transfer rollers 12 with the rotation of the photoconductors 2, the toner images formed on the photoconductors 2 are transferred onto the intermediate transfer belt 11 driven and rotated counterclockwise in FIG. 1 successively such that the toner images are superimposed on the intermediate transfer belt 11, forming a full color toner image thereon. Thereafter, the full color toner image formed on the intermediate transfer belt 11 is conveyed to the secondary transfer nip defined by the secondary transfer roller 13 in accordance with rotation of the intermediate transfer belt 11 and is transferred onto a sheet P conveyed to the secondary transfer nip. The sheet P is supplied from the sheet feeder 7. The timing roller pair 15 temporarily stops the sheet P fed from the sheet feeder 7 and conveys the sheet P to the secondary transfer nip, timed to coincide with the toner image on the intermediate transfer belt 11. Thus, the full-color toner image is formed on the sheet P. After the toner image is transferred onto the intermediate transfer belt 11, the cleaner 5 removes residual toner remained on the photoconductor 2 therefrom.

The sheet P transferred with the full color toner image is conveyed to the fixing device 9 that fixes the full color toner image on the sheet P. Thereafter, the sheet ejection device 10 ejects the sheet P onto the outside of the image forming apparatus 100, thus finishing a series of printing processes.

Next, a configuration of the fixing device 9 is described.

Figure 2:
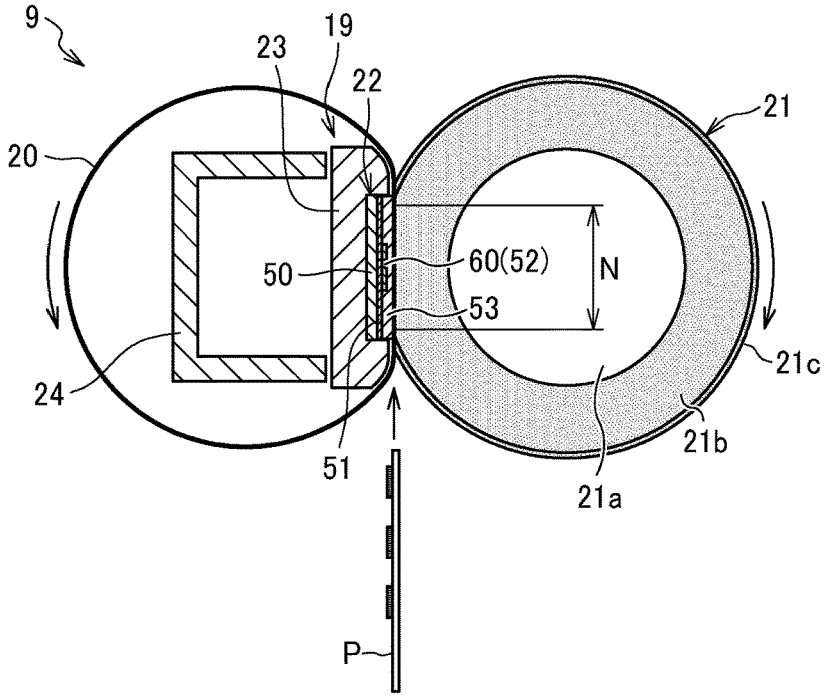
FIG. 2 is a schematic cross-sectional view of a main part of a fixing device incorporated in the image forming apparatus depicted in FIG. 1.
Figure 3:
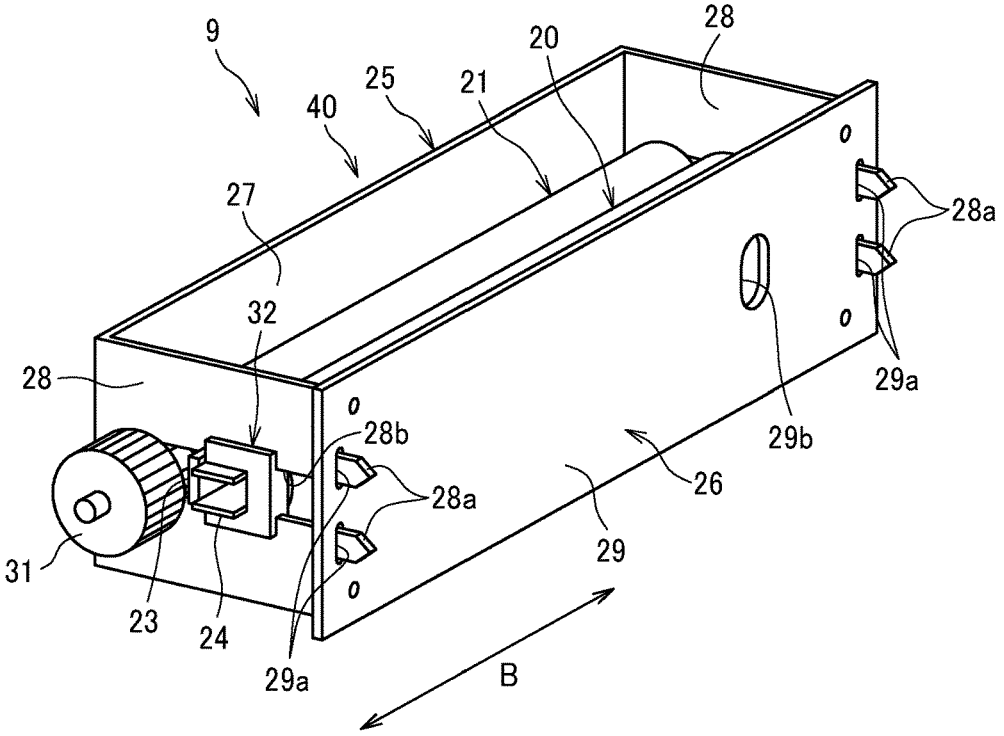
FIG. 3 is a perspective view of the fixing device depicted in FIG. 2.

As illustrated in FIG. 2, the fixing device 9 according to the present embodiment includes a fixing belt 20 as a fixing rotator, a pressure roller 21 as an opposed rotator to contact an outer circumferential surface of the fixing belt 20 and form a nip N, and a heating unit 19 to heat the fixing belt 20. The heating unit 19 includes a planar heater 22 as a heating member, a heater holder 23 as a holding member for holding the heater 22, and a stay 24 as a reinforcing member for reinforcing the heater holder 23 in the longitudinal direction. The fixing belt 20, the pressure roller 21, the heater 22, the heater holder 23, and the stay 24 extend in a direction perpendicular to the sheet surface of FIG. 2 (see a direction indicated by a double-headed arrow B in FIG. 3). Hereinafter, the direction indicated by the double-headed arrow B in FIG. 3 is referred to as a longitudinal direction of each member, an axial direction of the pressure roller 21, or a longitudinal direction of the fixing device 9 and the heating unit 19. The longitudinal direction is also the width direction of the sheet passing through the fixing device 9. However, the longitudinal direction of the heater 22 does not always need to coincide with the longitudinal direction of each member, device, or unit.

The fixing belt 20 is formed as an endless belt and includes, for example, a tubular base made of polyimide (PI), the tubular base having an outer diameter of 25 mm and a thickness of from 40 to 120 μm. The fixing belt 20 further includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 μm to 50 μm to enhance durability of the fixing belt 20 and facilitate separation of the sheet P and a foreign substance from the fixing belt 20. An elastic layer made of rubber having a thickness of from 50 to 500 μm may be interposed between the base and the release layer. The base of the fixing belt 20 may be made of heat resistant resin such as polyetheretherketone (PEEK) or metal such as nickel (Ni) and SUS stainless steel, instead of polyimide. An inner circumferential surface of the fixing belt 20 may be coated with polyimide, PTFE, or the like to produce a slide layer.

The pressure roller 21 having, for example, an outer diameter of 25 mm, includes a solid iron cored bar 21*a*, an elastic layer 21*b* on the surface of the bar 21*a*, and a release layer 21*c* formed on the outside of the elastic layer 21*b*. The elastic layer 21*b* is made of silicone rubber and has a thickness of 3.5 mm, for example. Preferably, the release layer 21*c* is formed by a fluororesin layer having, for example, a thickness of approximately 40 μm on the surface of the elastic layer 21*b* to improve releasability.

A spring serving as a biasing member described later causes the fixing belt 20 and the pressure roller 21 to press against each other. Thus, the nip N is formed between the fixing belt 20 and the pressure roller 21. As a driving force is transmitted to the pressure roller 21 from a driver disposed in the body of the image forming apparatus 100, the pressure roller 21 serves as a drive roller that drives and rotates the fixing belt 20. The fixing belt 20 is thus driven and rotated by the pressure roller 21 as the pressure roller 21 rotates. When the fixing belt 20 rotates, the fixing belt 20 slides on the heater 22. Therefore, in order to facilitate sliding performance of the fixing belt 20, a lubricant such as oil or grease may be provided between the heater 22 and the fixing belt 20.

The heater 22 extends in the longitudinal direction thereof and contacts the inner circumferential surface of the fixing belt 20 at a position corresponding to the pressure roller 21. The heater 22 includes a planar base 50, a first insulation layer 51 disposed on the base 50, a conductor layer 52 disposed on the first insulation layer 51, and a second insulation layer 53 that covers the conductor layer 52. The conductor layer 52 includes a heat generator 60. In the present embodiment, the base 50, the first insulation layer 51, the conductor layer 52 including the heat generator 60, and the second insulation layer 53 are layered in this order toward the fixing belt 20, that is, the nip N. Heat generated from the heat generator 60 is transmitted to the fixing belt 20 via the second insulation layer 53.

Alternatively, the heat generator 60 may be disposed on a surface of the base 50 facing the heater holder 23, that is, the surface opposite to a surface of the base 50 facing the fixing belt 20. In that case, since the heat of the heat generator 60 is transmitted to the fixing belt 20 through the base 50, it is preferable that the base 50 be made of a material with high thermal conductivity such as aluminum nitride. In the heater 22 according to the present embodiment, another insulation layer may be further disposed on a surface of the base 50 facing the heater holder 23, that is, the surface opposite to the surface of the base 50 facing the fixing belt 20.

The heater 22 may not contact the fixing belt 20 or may be disposed opposite the fixing belt 20 indirectly via a low-friction sheet or the like. However, the heater 22 preferably contacts the fixing belt 20 directly as in the present embodiment to enhance conduction of heat from the heater 22 to the fixing belt 20. The heater 22 may contact the outer circumferential surface of the fixing belt 20. However, if the outer circumferential surface of the fixing belt 20 is brought into contact with the heater 22 and damaged, the fixing belt 20 may degrade quality of fixing the toner image on the sheet P. Hence, preferably, the heater 22 contacts the inner circumferential surface of the fixing belt 20.

The heater holder 23 and the stay 24 are disposed inside a loop of the fixing belt 20. The stay 24 is configured by a channeled metallic member, and both side plates of the fixing device 9 support both end portions of the stay 24. The stay 24 supports a stay side face of the heater holder 23, that faces the stay 24 and is opposite a heater side face of the heater holder 23, that faces the heater 22. Accordingly, the stay 24 retains the heater 22 and the heater holder 23 to be immune from being bent substantially by pressure from the pressure roller 21, forming the fixing nip N between the fixing belt 20 and the pressure roller 21.

Since the heater holder 23 is subject to temperature increase by heat from the heater 22, the heater holder 23 is preferably made of a heat resistant material. The heater holder 23 is made of heat-resistant resin having low thermal conduction, such as a liquid crystal polymer (LCP) or polyether ether ketone (PEEK) and reduces heat transfer from the heater 22 to the heater holder 23 and provides efficient heating of the fixing belt 20.

As a print job starts, the heater 22 supplied with power causes the heat generator 60 to generate heat, thus heating the fixing belt 20. A driver drives and rotates the pressure roller 21, and the fixing belt 20 starts rotating with the rotation of the pressure roller 21. When the temperature of the fixing belt 20 reaches a predetermined target temperature called a fixing temperature, as illustrated in FIG. 2, the sheet P bearing an unfixed toner image is conveyed to the nip N between the fixing belt 20 and the pressure roller 21, and the unfixed toner image is heated and pressed onto the sheet P and fixed thereon.

Figure 4:
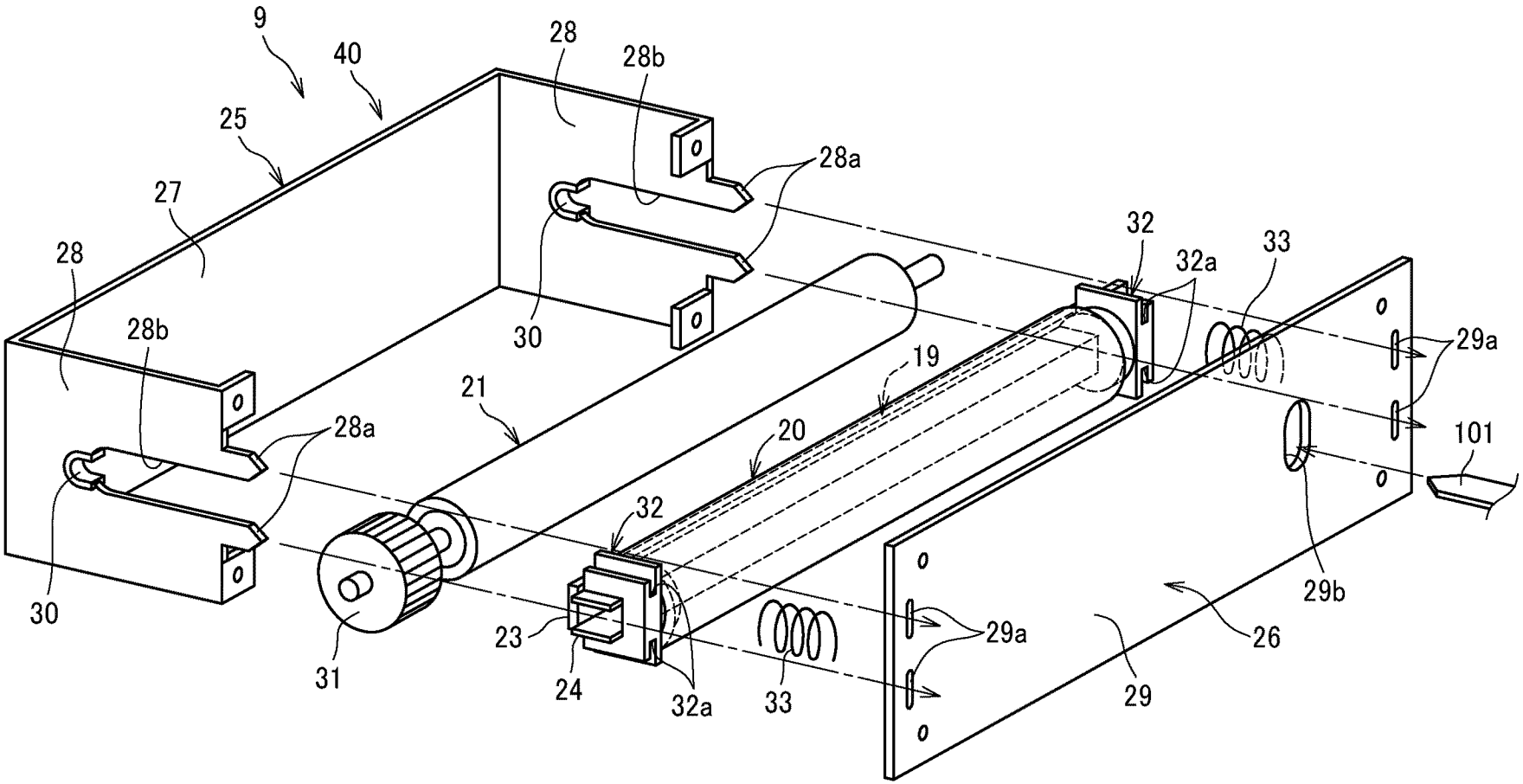
FIG. 4 is an exploded perspective view of the fixing device depicted in FIG. 2.

FIG. 3 is a perspective view of the fixing device 9. FIG. 4 is an exploded perspective view of the fixing device 9.

As illustrated in FIGS. 3 and 4, the fixing device 9 includes a housing 40 that includes a first device frame 25 and a second device frame 26. The first device frame 25 includes a pair of side walls 28 and a front wall 27. The second device frame 26 includes a rear wall 29. The side walls 28 are one lateral end wall and another lateral end wall. The side walls 28 support both lateral ends of each of the fixing belt 20, the pressure roller 21 and the heating unit 19, respectively. Each of the side walls 28 includes a plurality of engaging projections 28*a*. As the engaging projections 28*a* engage engaging holes 29*a* penetrating through the rear wall 29, respectively, the first device frame 25 is coupled to the second device frame 26. The housing 40 stores members of the fixing device 9 such as the fixing belt 20, the pressure roller 21, and the heating unit 19 including the heater 22. However, the housing 40 does not necessarily store all the members of the fixing device 9 inside the housing 40. An electronic board is disposed on the outer surface of the housing 40. The housing 40 has openings. The electronic board and the openings are described later.

Each of the side walls 28 includes a slot 28*b* through which a rotation shaft and the like of the pressure roller 21 are inserted. The slot 28*b* opens toward the rear wall 29 and closes at a portion opposite the rear wall 29, and the portion of the slot 28*b* opposite the rear wall 29 serves as a contact portion. A bearing 30 is disposed at an end of the contact portion to support the rotation shaft of the pressure roller 21. As both lateral ends of the rotation shaft of the pressure roller 21 are attached to the bearings 30, respectively, and the side walls 28 rotatably support the pressure roller 21.

A driving force transmission gear 31 serving as a driving force transmitter is disposed at one lateral end of the rotation shaft of the pressure roller 21 in an axial direction thereof. When the side walls 28 support the pressure roller 21, the driving force transmission gear 31 is exposed outside the side wall 28. Accordingly, when the fixing device 9 is installed in the body 103 of the image forming apparatus 100, the driving force transmission gear 31 is coupled to a gear disposed inside the body of the image forming apparatus 100 so that the driving force transmission gear 31 transmits the driving force from a driver to the pressure roller 21. Alternatively, the driving force transmitter to transmit the driving force to the pressure roller 21 may be pulleys over which a driving force transmission belt is stretched taut, a coupler, and the like instead of the driving force transmission gear 31.

A pair of supports 32 that supports the fixing belt 20, the heater holder 23, the stay 24, and the like is disposed at both ends of the heating unit 19 in a longitudinal direction thereof, respectively. Each support 32 has guide grooves 32*a*. As edges of the slot 28*b* of the side wall 28 enter the guide grooves 32*a*, respectively, the support 32 is attached to the side wall 28.

A pair of springs 33 serving as a pair of biasing members is interposed between each of the supports 32 and the rear wall 29. As the springs 33 bias the supports 32 and the stay 24 toward the pressure roller 21, respectively, the fixing belt 20 is pressed against the pressure roller 21 to form the fixing nip between the fixing belt 20 and the pressure roller 21.

As illustrated in FIG. 4, a hole 29*b* is disposed near one end of the rear wall 29 of the second device frame 26 in a longitudinal direction of the second device frame 26. The hole 29*b* serves as a positioner of the fixing device 9 that positions the body of the fixing device 9 with respect to the body 103 of the image forming apparatus 100. Similarly, the body 103 of the image forming apparatus 100 includes a projection 101 as a positioner fixed on the image forming apparatus 100. The projection 101 is inserted into the hole 29*b* of the fixing device 9. Accordingly, the projection 101 engages the hole 29*b*, positioning the body of the fixing device 9 with respect to the body 103 of the image forming apparatus 100 in the longitudinal direction of the fixing device 9. Although the hole 29*b* serving as the positioner is disposed near one end of the rear wall 29 in the longitudinal direction of the second device frame 26, a positioner is not disposed near another end of the rear wall 29. Thus, the second device frame 26 does not restrict thermal expansion and shrinkage of the body of the fixing device 9 in the longitudinal direction of the fixing device 9 due to temperature change.

Figure 5:
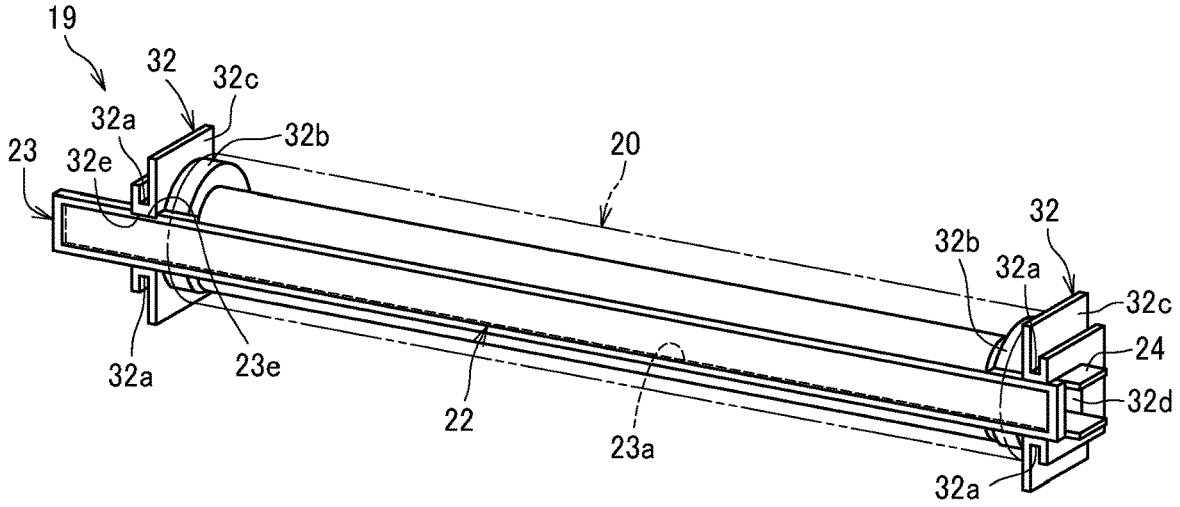
FIG. 5 is a perspective view of a heating unit incorporated in the fixing device depicted in FIG. 2.
Figure 6:
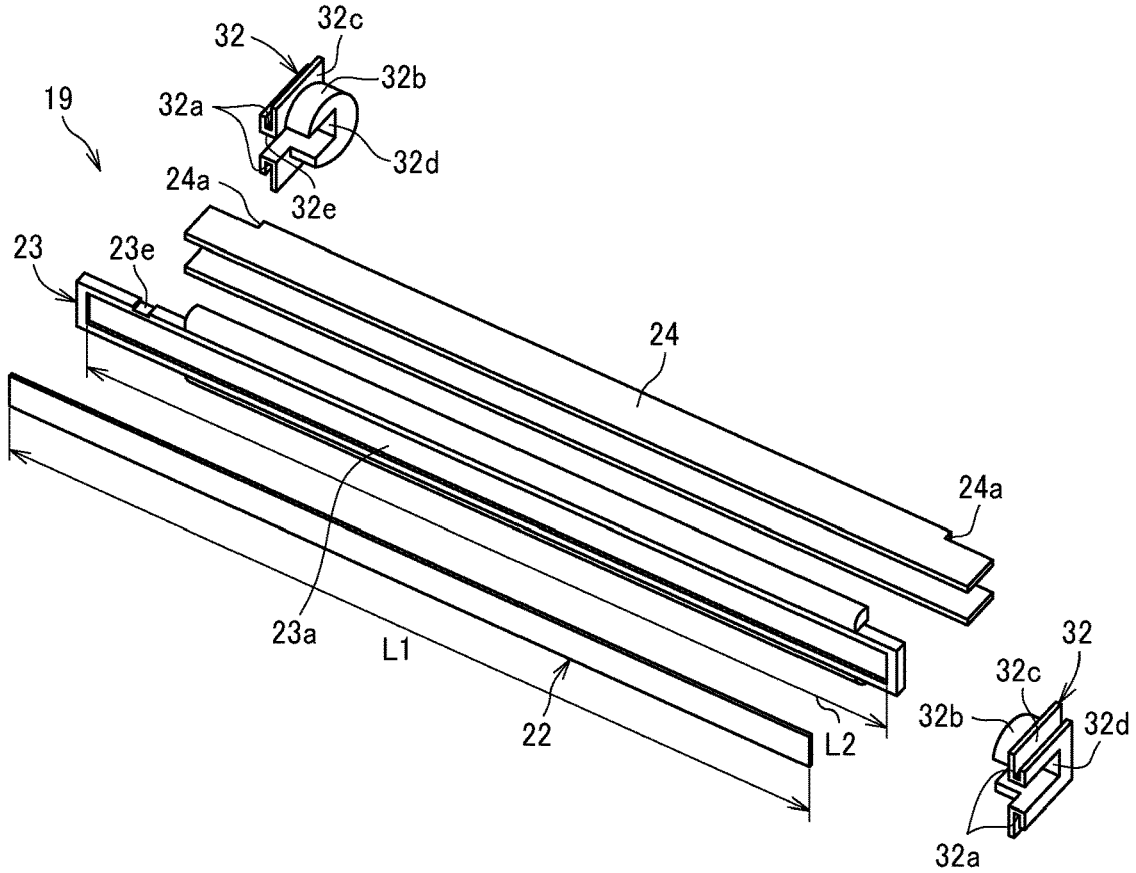
FIG. 6 is an exploded perspective view of the heating unit depicted in FIG. 5.

FIG. 5 is a perspective view of the heating unit 19, and FIG. 6 is an exploded perspective view of the heating unit 19.

As illustrated in FIGS. 5 and 6, the heater holder 23 includes an accommodating recess 23*a* disposed on a fixing belt side face of the heater holder 23, that is a face on a front side in FIGS. 5 and 6. The accommodating recess 23*a* is rectangular and accommodates the heater 22. The accommodating recess 23*a* has a similar shape and size of the heater 22, but a length L2 of the accommodating recess 23*a* in the longitudinal direction of the heater holder 23 is set slightly longer than a length L1 of the heater 22 in the longitudinal direction of the heater 22. The accommodating recess 23*a* formed slightly longer than the heater 22 does not interfere with the heater 22 even when the heater 22 expands in the longitudinal direction due to thermal expansion. The accommodating recess 23*a* accommodates the heater 22, and the heater 22 is sandwiched by the heater holder 23 and a connector as a power supplying member described below, thus the heater 22 is held.

Each of the pair of supports 32 includes a belt support 32*b*, a belt restrictor 32*c*, and a supporting recess 32*d*. The belt support 32*b* is C-shaped and inserted into the loop formed by the fixing belt 20, thus contacting the inner circumferential surface of the fixing belt 20 to support the fixing belt 20. The belt restrictor 32*c* is a flange that contacts an edge face of the fixing belt 20 to restrict motion (e.g., skew) of the fixing belt 20 in the width direction of the fixing belt 20. A lateral end of each of the heater holder 23 and the stay 24 in the longitudinal direction thereof is inserted into the supporting recess 32*d*, thus the supporting recess 32*d* supports the heater holder 23 and the stay 24. As the belt support 32*b* is inserted into the loop formed by the fixing belt 20 on each axial end of the fixing belt 20, the fixing belt 20 is supported by a free belt system in which the fixing belt 20 is not stretched basically in a circumferential direction of the fixing belt 20, which is a rotation direction of the fixing belt 20, while the fixing belt 20 does not rotate.

As illustrated in FIGS. 5 and 6, the heater holder 23 includes a positioning recess 23*e*, serving as a positioner, disposed at one lateral end of the heater holder 23 in the longitudinal direction thereof. The support 32 includes an engagement 32*e* illustrated in a left part in FIGS. 5 and 6. The engagement 32*e* engages the positioning recess 23*e*, positioning the heater holder 23 with respect to the support 32 in the longitudinal direction of the heater holder 23. The support 32 illustrated in a right part in FIGS. 5 and 6 does not include the engagement 32*e* and therefore the heater holder 23 is not positioned with respect to the support 32 in the longitudinal direction of the heater holder 23. Positioning the heater holder 23 with respect to the support 32 near one end of the heater holder 23 in the longitudinal direction of the fixing belt 20 does not restrict an expansion and contraction of the heater holder 23 in the longitudinal direction of the fixing belt 20 due to a temperature change.

As illustrated in FIG. 6, the stay 24 includes step portions 24*a* at both ends in the longitudinal direction of the stay 24 to restrict movement of the stay 24 relative to the support 32. Each step portion 24*a* abuts the support 32 to restrict movement of the stay 24 in the longitudinal direction with respect to the support 32. However, at least one of the step portions 24*a* is arranged to have a gap, that is, loose fit with play between the step portion 24*a* and the support 32. The above-described arrangement of the gap between the support 32 and at least one of the step portions 24*a* does not restrict thermal expansion or shrinkage of the stay 24 in the longitudinal direction of the fixing belt 20 caused by changes in temperature.

Figure 7:
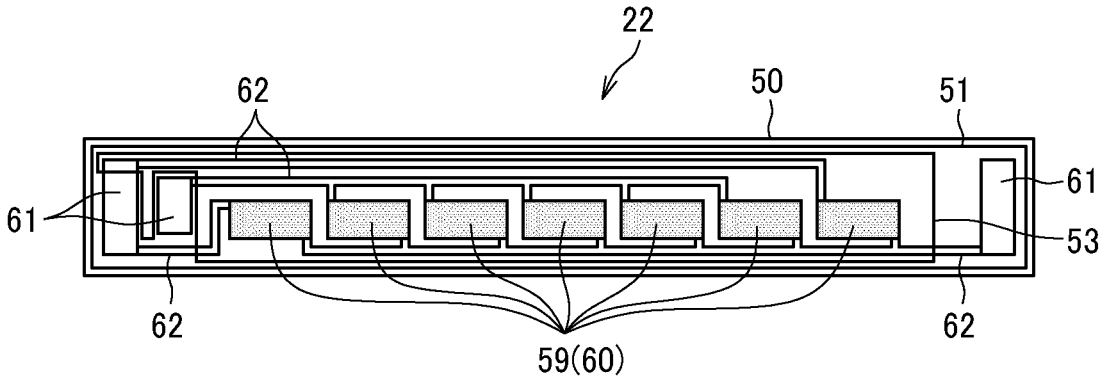
FIG. 7 is a plan view of a heater.
Figure 8:
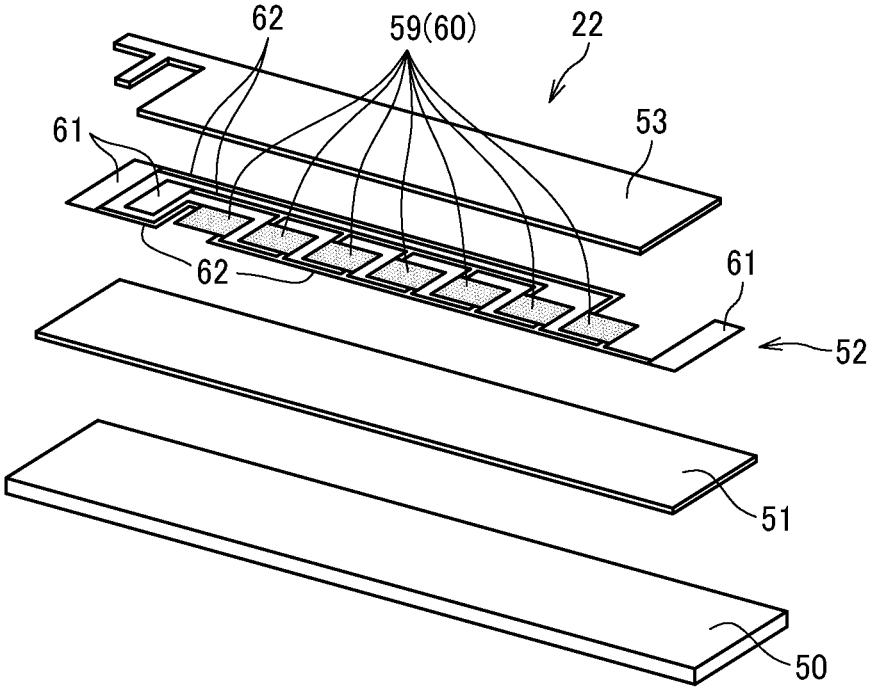
FIG. 8 is an exploded perspective view of the heater depicted in FIG. 7.

FIG. 7 is a plan view of the heater 22. FIG. 8 is an exploded perspective view of the heater 22.

As illustrated in FIG. 8, the heater 22 includes a base 50, a first insulation layer 51 disposed on the base 50, a conductor layer 52 disposed on the first insulation layer 51, and a second insulation layer 53 that covers the conductor layer 52.

The base 50 is a long plate made of a metal such as stainless steel (SUS), iron, or aluminum. The base 50 may be made of ceramic, glass, etc. instead of metal. If the base 50 is made of an insulating material such as ceramic, the first insulation layer 51 sandwiched between the base 50 and the conductor layer 52 may be omitted. Since metal has an excellent durability when it is rapidly heated and is processed readily, metal is preferably used to reduce manufacturing costs. Among metals, aluminum and copper are preferable because aluminum and copper have high thermal conductivity and are less likely to cause uneven temperature. Stainless steel is advantageous because stainless steel is manufactured at reduced costs compared to aluminum and copper.

The first insulation layer 51 and the second insulation layer 53 are made of material having electrical insulation, such as heat-resistant glass. Alternatively, each of the first insulation layer 51 and the second insulation layer 53 may be made of ceramic, polyimide (PI), or the like.

The conductor layer 52 includes the heat generator 60, a plurality of electrodes 61, and a plurality of power supply lines 62. The heat generator 60 includes resistive heat generators 59 arranged in the longitudinal direction of the heater 22. The plurality of power supply lines 62 that electrically connects the heat generator 60 and the plurality of electrodes 61. Each of the resistive heat generators 59 is electrically connected to any two of the three electrodes 61 in parallel to each other via the plurality of power supply lines 62 disposed on the base 50. Thus, the resistive heat generators 59 are electrically connected in parallel to each other.

The resistive heat generator 59 is produced by, for example, mixing silver-palladium (AgPd), glass powder, and the like into a paste. The paste is coated on the base 50 by screen printing or the like. Thereafter, the base 50 is fired to form the heat generator 60. Alternatively, the resistive heat generator 59 may be made of a resistive material such as a silver alloy (AgPt) and ruthenium oxide ($RuO_2$).

The power supply lines 62 are made of conductors having an electrical resistance value smaller than the electrical resistance value of the resistive heat generators 59. Silver (Ag), silver palladium (AgPd) or the like may be used as a material of the power supply lines 62 or the electrodes 61. Screen-printing such a material forms the power supply lines 62 or the electrodes 61.

Figure 9:
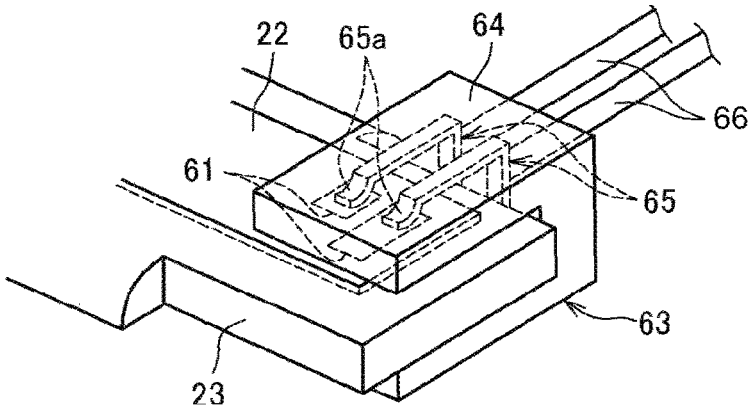
FIG. 9 is a perspective view of the heater and a connector coupled to the heater.

FIG. 9 is a perspective view of the heater 22 and a connector 63 coupled to the heater 22.

As illustrated in FIG. 9, the connector 63 includes a housing 64 made of resin and a plurality of contact terminals 65 disposed in the housing 64. Each contact terminal 65 is configured by a flat spring and connected to a power supply harness 66.

As illustrated in FIG. 9, the connector 63 is attached to the heater 22 and the heater holder 23 such that a front side of the heater 22 and the heater holder 23 and a back side of the heater 22 and the heater holder 23 are sandwiched by a connector 63. Thus, contact portions 65*a* disposed at ends of the contact terminals 65 elastically contact and press against the electrodes 61 each corresponding to the contact terminals 65, and the heat generator 60 is electrically connected to the power supply provided in the image forming apparatus 100 via the connector 63. The above-described configuration enables the power supply to supply power to the heat generator 60. Note that, as illustrated in FIG. 7, at least part of each of the electrodes 61 is not coated by the second insulation layer 53 and therefore exposed to secure connection with the corresponding connector 63.

Figure 10:
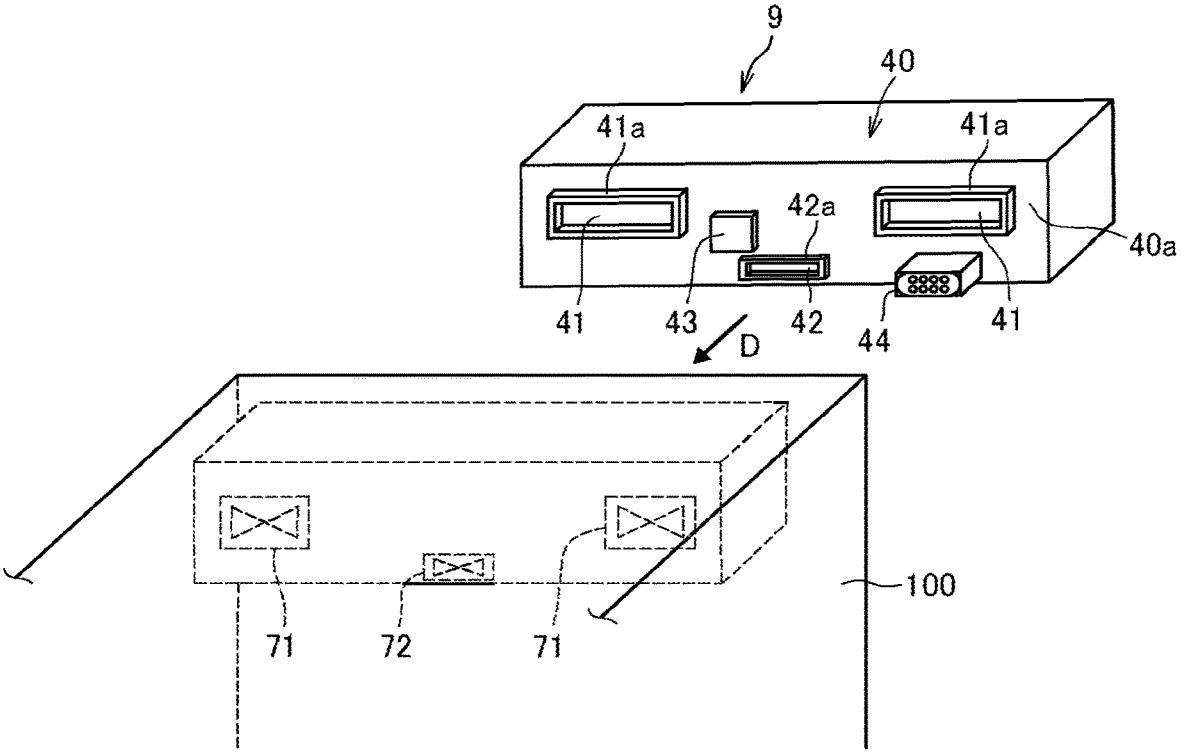
FIG. 10 is a schematic perspective view of the fixing device and an outline of the image forming apparatus in FIG. 1 to illustrate installation of the fixing device in FIG. 2.

As illustrated in FIG. 10, an outer face 40*a* of the housing 40 of the fixing device 9 has two air blowing ports 41 as a first opening and an air intake port 42 as a second opening that is another opening. The air blowing ports 41 are disposed on both end regions of the outer face 40*a* in the longitudinal direction of the fixing device 9. An electronic board 43 and a connector 44 are disposed on the outer face 40*a* of the housing 40. Among outer faces of the housing 40, the outer face 40*a* having the air blowing ports 41 and the electronic board 43 is the face at the downstream side in a direction for installation of the fixing device 9 with respect to the image forming apparatus 100 and the face located in the innermost space of the image forming apparatus 100 when the fixing device 9 is installed in the image forming apparatus 100.

Seals 41*a* and 42*a* are disposed on peripheral areas around the air blowing ports 41 and the air intake port 42, respectively and projected outside from the outer face 40*a*. The electronic board 43 includes a memory to store, for example, various adjustment values regarding the fixing device 9 and data related to time such as the number of printed sheets. The connector 44 is coupled to a terminal in the body 103 of the image forming apparatus 100. The seals 41*a* and 42*a* fill and seal gaps between the housing 40 and ducts on the image forming apparatus 100, which is described later, and are made of sponge as elastic material in the present embodiment.

The fixing device 9 is attached to and detached from the image forming apparatus 100. An arrow D in FIG. 10 indicates the direction for installation of the fixing device 9 with respect to the image forming apparatus 100, and the fixing device 9 is installed in a space indicated by dotted lines in FIG. 10.

The image forming apparatus 100 includes blower fans 71 as a first airflow generator to blow air to the air blowing ports 41 of the fixing device 9 and an intake air fan 72 as a second airflow generator as an intake airflow generator to take air from the air intake port 42. The airflow generated by the blower fan 71 is blown into the fixing device 9 from the air blowing ports 41 and is discharged to the outside of the fixing device 9 from the air intake port 42.

Figure 11:
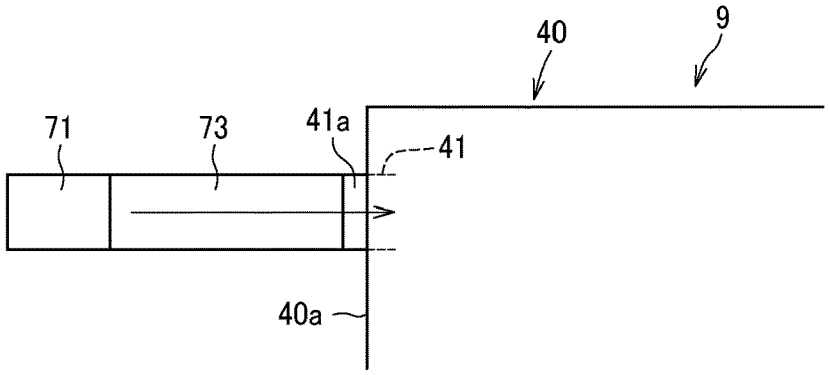
FIG. 11 is a schematic diagram illustrating an air blowing path from an air blowing fan to an air blowing port, according to an embodiment of the present disclosure.

As illustrated in FIG. 11, a case of the blower fan 71 is connected to a duct 73 to blow air from the air blowing port 41 into the fixing device 9 (see an arrow in FIG. 11). The seal 41*a* disposed on the peripheral area around the air blowing port 41 and projected outside from the outer face 40*a* seals the gap between the housing 40 and the duct 73, and the blower fan 71 can blow air into the fixing device 9 without leaking (however, there is an exception about an airflow path from a hole described below).

The fixing device 9 handles a plurality of sizes of sheets having various widths. When the sheets having a small width continuously printed, a heat generation area of the heater having a width larger than a sheet conveyance span in a longitudinal direction of the heater increases temperatures at both end portions of the fixing belt corresponding to a non-sheet conveyance span, which causes a so-called temperature rise problem at the both end portions. In the present embodiment, the airflow is blown into the fixing device 9 from the air blowing ports 41 disposed on both end regions of the outer face 40*a* in the longitudinal direction of the fixing device 9 to cool both end portions of the fixing device 9 in the longitudinal direction of the fixing device 9. The above-described configuration cools portions of the fixing device 9 corresponding to the non-sheet conveyance span and can prevent the both end portions of the fixing belt corresponding to the non-sheet conveyance span from overheating.

As described above, the blower fans 71 and the intake air fan 72 in the present embodiment generate the airflow in the fixing device 9 and can cool the fixing device 9. As a result, the above-described configuration can prevent the both end portions of the fixing belt from overheating and prevent heat from being accumulated in the fixing device 9.

Depending on the configuration of the fixing device 9, cooling not only the inside of the fixing device 9 but also the outer face of the fixing device such as the outer face 40*a* of the housing 40 may be needed. For example, when the electronic board 43 as an object to be cooled is disposed on the outer face 40*a* of the housing 40 of the fixing device 9 as in the present embodiment, energizing the fixing device 9 increases the temperature of the electronic board 43 and may cause a failure of the electronic board 43.

Figure 12:
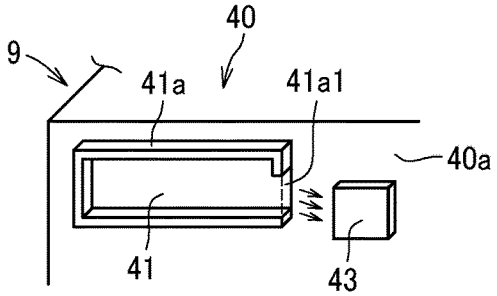
FIG. 12 is a schematic partial perspective view of the fixing device according to an embodiment of the present disclosure to illustrate an electronic board and an airflow path to the electronic board.

To prevent the failure, a part of the seal 41*a* disposed at the peripheral area of the air blowing port 41 in the present embodiment is cut away as illustrated in FIG. 12 to form a first hole 41*a*1 opening toward the electronic board 43 (that is the right side of the seal 41*a* in FIG. 12). The first hole 41*a*1 opening toward the electronic board 43 is formed outside from the outer face 40*a* of the housing 40.

From the first hole 41*a*1, a part of the airflow flowing from the blower fan 71 into the fixing device 9 via the duct 73 and the air blowing port 41 flows to the outer face 40*a* of the housing 40, in particular, to the electronic board 43 (see arrows in FIG. 12). In other words, the image forming apparatus 100 has an airflow path from the blower fan 71 to the outer face 40*a* of the housing 40 (that is, the electronic board 43) via the duct 73 and the first hole 41*a*1 in addition to an inner airflow path from the blower fan 71 to the inside of the fixing device 9 via the duct 73 and the air blowing port 41 (that is an airflow path to the inside of the fixing device 9). The airflow path branched from the inner airflow path and passing through the first hole 41*a*1 is referred to as an outer airflow path.

The above-described outer airflow path enables the airflow to flow to the outer face 40*a* of the housing 40 and cool the outer face 40*a* of the housing 40. In particular, the airflow in the present embodiment can cool the electronic board 43. As a result, the airflow can prevent the electronic board 43 from overheating and prevent the failure of the electronic board 43. The outer airflow path branched from the inner airflow path as a cooling path does not need another airflow generator for the outer airflow path. Accordingly, the image forming apparatus 100 can be reduced in size and cost.

An object to be cooled by the airflow generation device of the present embodiment is not limited to the electronic board 43. The airflow generation device of the present embodiment may have an airflow path that flows airflow to cool the connector 44 on the outer face 40*a* of the housing 40 as the object to be cooled. Alternatively, the airflow generation device of the present embodiment may cool a part of the outer face 40*a* of the housing 40 as the object to be cooled. For example, the airflow generation device of the present embodiment may have the outer airflow path that flows the airflow to the part of the outer face 40*a* in which condensation is likely to occur.

Figure 13:
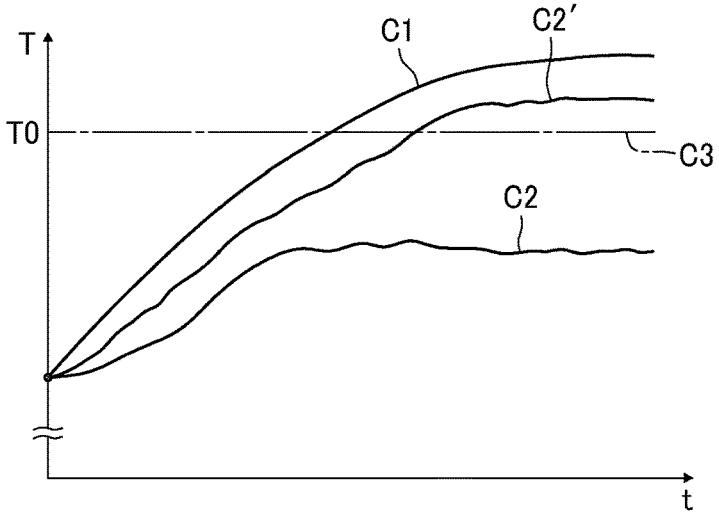
FIG. 13 is a graph illustrating temperature rises on an outer surface of a housing of the fixing device during continuous printing.

FIG. 13 is a graph illustrating temperature changes detected by temperature detectors in some parts of the fixing device during continuous printing. In FIG. 13, the horizontal axis represents the continuous printing time t in the fixing device, and the vertical axis represents the detected temperature T. A solid line C1 in FIG. 13 indicates the temperature of the outer face 40*a* of the housing 40 of the fixing device 9 at a position away from the airflow path from the first hole 41*a*1, a solid line C2 indicates the temperature around the electronic board 43, and an alternate long and short dash line C3 indicates a failure risk temperature that may cause the failure of the electronic board 43. A solid line C2' indicates the temperature around the electronic board 43 in a fixing device that is different from the fixing device according to the present embodiment and does not have the first hole 41*a*1 in the seal 41*a*.

As illustrated in FIG. 13, as the continuous printing time t increases, the temperatures indicated by the solid lines C1, C2, and C2' increase. In particular, the solid line C2' exceeds the failure risk temperature TO indicated by the alternate long and short dash line C3 when the number of sheets continuously printed exceeds a certain number of sheets. In contrast, the solid line C2 does not exceed the failure risk temperature TO. This shows the cooling effect of the airflow in the outer airflow path.

Thus, disposing the airflow path for the airflow to the electronic board 43 prevents the temperature of the electronic board 43 from increasing and prevents the failure of the electronic board 43.

Next, another embodiment of the fixing device 9 different from the above-described embodiment is described with reference to FIG. 14.

Figure 14:
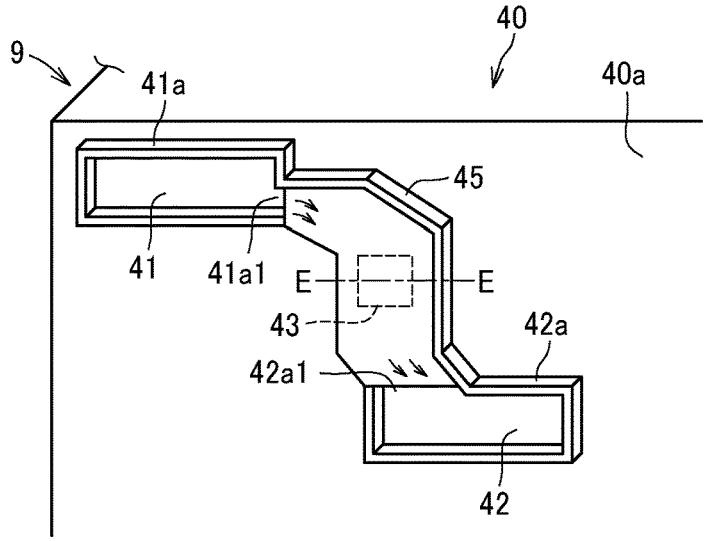
FIG. 14 is a schematic partial perspective view of the fixing device according to another embodiment.

As illustrated in FIG. 14, in the fixing device 9 of the present embodiment, a part of the seal 42*a* disposed around the peripheral area of the air intake port 42 is cut away to form a second hole 42*a*1 near the electronic board 43. The second hole 42*a*1 is formed outside from the outer face 40*a* of the housing 40. In addition, the fixing device 9 includes a duct 45 as an airflow path member. The duct 45 communicates with the second hole 42*a*1 and the first hole 41*a*1 of the seal 41*a* disposed around the peripheral area of the air blowing port 41. The electronic board 43 is disposed in the duct 45.

Figure 15:
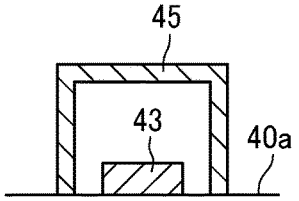
FIG. 15 is a cross-sectional view of a duct on the fixing device along a line E-E of FIG. 14.

The duct 45 is continuously connected to the seals 41*a* and 42*a*. As illustrated in FIG. 15, the electronic board 43 is covered by the outer face 40*a* and the duct 45. However, since the duct 45 has a hole through which the wiring of the electronic board 43 passes, the duct 45 does not completely seal the electronic board 43.

In the present embodiment, the airflow path toward the electronic board 43 is connected to the air intake port 42. That is, the airflow path is formed in the order of the blower fan 71, the duct 73 (see FIG. 11), the first hole 41*al*, the duct 45, and the second hole 42*a*1. The duct 45 forms an airflow path from the first hole 41*a*1 to the second hole 42*a*1. In particular, the airflow path passing through the first hole 41*a*1 is the outer airflow path branched from the original airflow path. Disposing the duct 45 communicating with the first hole 41*a*1 and the second hole 42*a*1 enables the airflow to guide in the direction from the first hole 41*a*1 to the second hole 42*a*1 via the duct 45 and efficiently blow air toward the outer face 40*a* and the electronic board 43. As a result, the cooling effect for the electronic board 43 can be improved. In particular, since the airflow path toward the electronic board 43 is covered by the duct 45 and the outer face 40*a* of the housing 40, the electronic board 43 can be efficiently cooled.

In addition, the intake air fan 72 is disposed downstream from the air intake port 42 in the direction of intake air to take in air from the fixing device 9 through the air intake port 42. The intake air can actively form the airflow in the direction from the first hole 41*a*1 to the second hole 42*a*1 via the duct 45. As a result, the electronic board 43 can be efficiently cooled.

In the above-described embodiment, the airflow path is formed from one of the blower fans 71 and one of the air blowing ports 41 to the outer face 40*a* of the housing 40 (in particular, the electronic board 43) but may be formed from both the blower fans 71 and both the air blowing ports 41 to the outer face 40*a* of the housing 40.

The present disclosure is not limited to the details of the embodiments described above and various modifications and improvements are possible.

Figure 16:
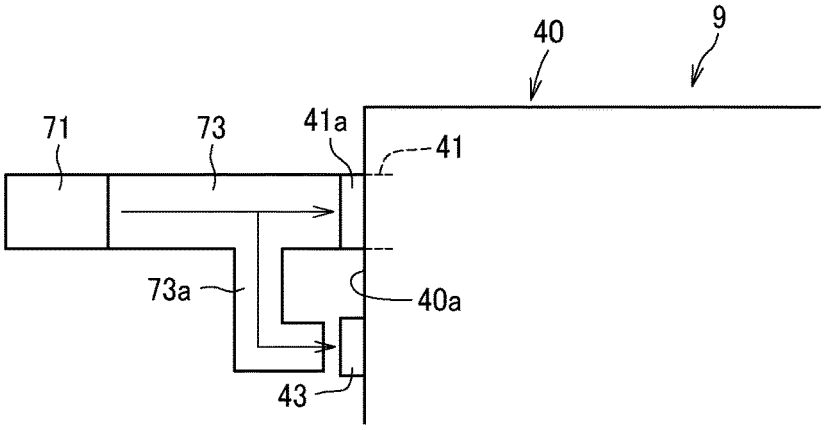
FIG. 16 is a schematic view of a fork path disposed in the image forming apparatus.

In the above-described embodiments, the fixing device 9 has the holes to form the outer airflow path on the outer face of the housing of the fixing device, but the present disclosure is not limited to this. For example, as illustrated in FIG. 16, the image forming apparatus 100 may include the duct 73 and a fork path 73*a* to form the airflow path toward the electronic board 43 (or the outer face 40*a* of the housing 40). Alternatively, a part of the duct 73 may have a hole to form the outer airflow path that flows air to the outer face 40*a* of the housing 40.

In the present embodiment, the blower fan to blow air to the fixing device 9 is used to blow the air to the outer face 40*a* of the housing 40 (particularly, the electronic board 43). However, as illustrated in FIG. 17, another blower fan 74 as another airflow generator may be separately disposed in the image forming apparatus 100. The blower fan 74 directly faces the housing 40 of the fixing device 9 and blows air to the outer face 40*a* of the housing 40.

A heating device according to the present disclosure is not limited to the fixing device described in the above embodiments. The heating device according to the present disclosure is also applicable to, for example, a heating device such as a dryer to dry ink applied to the sheet, a coating device (a laminator) that heats, under pressure, a film serving as a covering member onto the surface of the sheet such as paper, and a thermocompression device such as a heat sealer that seals a seal portion of a packaging material with heat and pressure. Applying the present disclosure to the above heating devices can form the airflow on the outer faces of the housings of the heating devices to prevent the outer faces of the housings from increasing temperature.

The image forming apparatus according to the present embodiments of the present disclosure is applicable not only to a color image forming apparatus 100 illustrated in FIG. 1 but also to a monochrome image forming apparatus, a copier, a printer, a facsimile machine, or a multifunction peripheral including at least two functions of the copier, printer, and facsimile machine.

The sheets P serving as recording media may be thick paper, postcards, envelopes, plain paper, thin paper, coated paper, art paper, tracing paper, overhead projector (OHP) transparencies, plastic film, prepreg, copper foil, and the like.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A heating device comprising:

a heater;

a housing;

an airflow path to flow air from an airflow generator into the housing; and an outer airflow path to flow air from the airflow generator to an outer face of the housing.

2. The heating device according to claim 1, further comprising an object to be cooled disposed on the outer face of the housing on which the outer airflow path is disposed.

3. The heating device according to claim 2, wherein the object to be cooled is an electronic board.

4. The heating device according to claim 1, wherein the housing has an opening to flow the air from the airflow generator into an inside of the housing and a seal disposed on a peripheral area around the opening and projected outside from the outer face of the housing, and wherein the outer airflow path has a hole in the seal.

5. The heating device according to claim 1, further comprising a portion disposed downstream in a direction of airflow in the outer airflow path from an object to be cooled, wherein air in the portion is to be taken by an intake airflow generator.

6. The heating device according to claim 5, wherein the housing has another opening through which the air is to be taken by the intake airflow generator and another seal disposed on a peripheral area around said another opening and projected outside from the outer face of the housing, and wherein said another seal has another hole.

7. The heating device according to claim 1, further comprising a duct inside which an object to be cooled is disposed, wherein the housing has an opening to flow the air from the airflow generator into an inside of the housing and a seal disposed on a peripheral area around the opening and projected outside from the outer face of the housing, wherein the outer airflow path has a hole in the seal, wherein the housing has another opening through which the air is to be taken by an intake airflow generator and another seal disposed on a peripheral area around said another opening and projected outside from the outer face of the housing, wherein said another seal has another hole, and wherein the duct communicate with the hole and said another hole.

8. The heating device according to claim 7, wherein the outer airflow path communicates with a path covered by the outer face of the housing and the duct.

9. A fixing device comprising the heating device according to claim 1.

10. An image forming apparatus comprising the heating device according to claim 1.

11. An image forming apparatus comprising:

the heating device according to claim 1; and the airflow generator facing an outer face of the housing.

* * * * *